US008708140B2

(12) United States Patent
Liu

(10) Patent No.: US 8,708,140 B2
(45) Date of Patent: Apr. 29, 2014

(54) MOBILE DEVICE ENCLOSURE SYSTEM

(71) Applicant: Warren Liu, Chino, CA (US)

(72) Inventor: Warren Liu, Chino, CA (US)

( * ) Notice: Subject to any disclaimer, the term of this patent is extended or adjusted under 35 U.S.C. 154(b) by 0 days.

(21) Appl. No.: 13/958,392

(22) Filed: Aug. 2, 2013

(65) Prior Publication Data

US 2014/0034521 A1 Feb. 6, 2014

Related U.S. Application Data

(60) Provisional application No. 61/678,941, filed on Aug. 2, 2012.

(51) Int. Cl.
*B65D 85/00* (2006.01)

(52) U.S. Cl.
USPC ..... 206/45.23; 206/320; 206/473

(58) Field of Classification Search
USPC ..... 206/45.2, 45.23, 45.24, 320, 576, 472, 206/473, 701, 722; 312/458, 460, 461, 462, 312/463, 176.1, 918
See application file for complete search history.

(56) References Cited

U.S. PATENT DOCUMENTS

| | | | | |
|---|---|---|---|---|
| 4,400,161 | A * | 8/1983 | Gerlt | 434/104 |
| 6,772,879 | B1 * | 8/2004 | Domotor | 206/45.23 |
| 7,673,745 | B2 * | 3/2010 | Sirichai et al. | 206/45.23 |
| 8,201,687 | B2 * | 6/2012 | Zeliff et al. | 206/320 |
| 8,230,992 | B2 * | 7/2012 | Law et al. | 206/320 |
| 8,312,991 | B2 * | 11/2012 | Diebel et al. | 206/45.24 |
| 2008/0237432 | A1 * | 10/2008 | Patterson | 248/458 |
| 2011/0215217 | A1 * | 9/2011 | De La Garza | 248/397 |
| 2012/0012483 | A1 * | 1/2012 | Fan | 206/320 |
| 2012/0043247 | A1 * | 2/2012 | Westrup | 206/472 |
| 2012/0153116 | A1 * | 6/2012 | Harrison | 248/460 |
| 2012/0217174 | A1 * | 8/2012 | Ting | 206/45.2 |
| 2012/0224305 | A1 * | 9/2012 | Yoo | 361/679.01 |
| 2013/0001107 | A1 * | 1/2013 | Armstrong | 206/216 |
| 2013/0015088 | A1 * | 1/2013 | Wu | 206/320 |
| 2013/0134061 | A1 * | 5/2013 | Wu et al. | 206/320 |
| 2013/0213838 | A1 * | 8/2013 | Tsai et al. | 206/320 |
| 2013/0264241 | A1 * | 10/2013 | McCosh et al. | 206/472 |

* cited by examiner

*Primary Examiner* — Jacob K Ackun

(57) ABSTRACT

A mobile device enclosure system is an apparatus that is provided as a means to protect a mobile device from the wear and tear of daily usage without limiting the portability of the mobile device or the accessibility of said mobile device's hardware keys or charging ports. The apparatus accomplishes this through the use of an inner sleeve and an outer case. The inner sleeve is enclosed within the outer case. The inner sleeve houses the mobile device and protects it from everyday wear and tear while the outer case houses both the inner sleeve and the mobile device protecting them from accidental damage. Additionally, the configuration of the inner sleeve and the outer case permits the mobile device to be particularly oriented and positioned in order to conform to a tradition landscape and portrait display view as well as alternative configurations.

18 Claims, 8 Drawing Sheets

MOBILE DEVICE ENCLOSURE SYSTEM

The current application claims a priority to the U.S. Provisional Patent application Ser. No. 61/678,941 filed on Aug. 2, 2012.

FIELD OF THE INVENTION

The present invention relates generally to an apparatus enclosure, more specifically to a mobile device enclosure that is configurable in a manner that allows for various viewable orientations of the enclosed mobile device while additionally providing protection form wear and tear.

BACKGROUND OF THE INVENTION

With the advent of new technology, people have become more reliant on mobile devices to enhance and facilitate their daily activities. Many of these mobile devices, such as tablet PCs, combine the function of several electronic devices into a singular device with a wide range of functionality. While these mobile devices have become essential for managing the daily lives of many people, their daily usage will oftentimes cause wear and tear on the device itself. In most situations, the signs of wear are merely cosmetic but if a user were to drop the device, irreparable damage can be caused the mobile device. This can oftentimes lead to expensive repair costs but more commonly will result in the device having to be completely replaced.

Although there exist several systems and methods for protecting these mobile devices from normal wear and tear and accidental damage, these systems often times limit the functionality of the mobile device. These existing system are generally designed to be external enclosures that envelope the mobile device, functioning as a protective barriers. The disadvantage with these systems is that they generally end up limiting the portability of the mobile device as well as the accessibility of charging ports and hardware keys. Furthermore, these existing systems make it difficult to utilize the mobile devices in alternative capacities, such as a stand along touch screen keyboards and viewing platforms due to the protective cover enclosing particular design features of the mobile device.

It is therefore the object of the present invention, to provide a mobile device enclosure system that is able to protect a mobile device from the wear and tear of daily usage without limiting the portability of the mobile device or the accessibility of said mobile device's hardware keys or charging ports. The present invention accomplishes this through the use of an inner sleeve and an outer case. The inner sleeve is enclosed within the outer case. The inner sleeve houses the mobile device and protects it from everyday wear and tear while the outer case houses both the inner sleeve and the mobile device protecting them from accidental damage. Additionally, the configuration of the inner sleeve and the outer case permits the mobile device to be particularly oriented and positioned in order to conform to alternative configurations and a display states if necessary.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
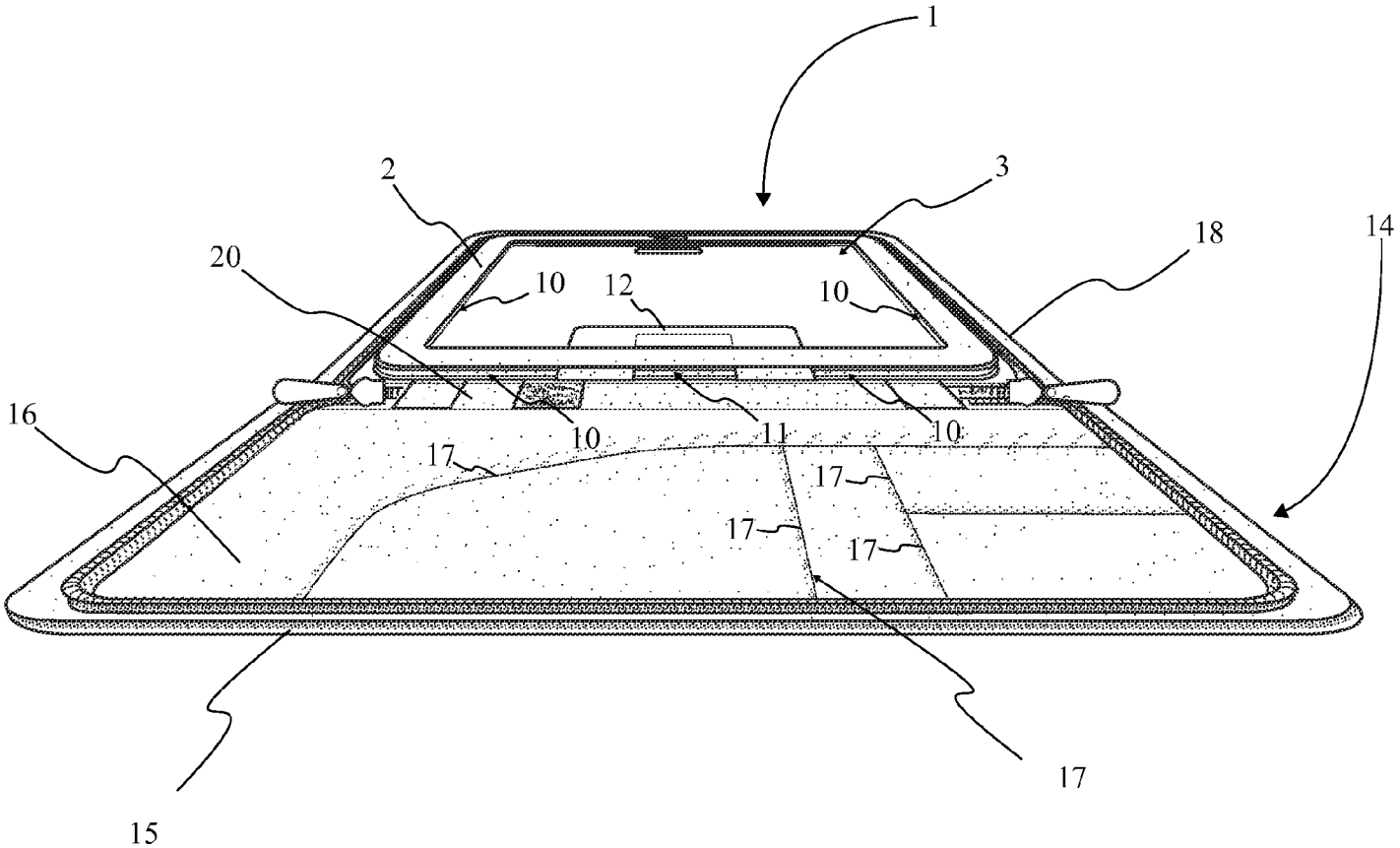
FIG. 1 is a perspective view displaying the inner sleeve attached to the outer case as per the current embodiment of the present invention.
Figure 2:
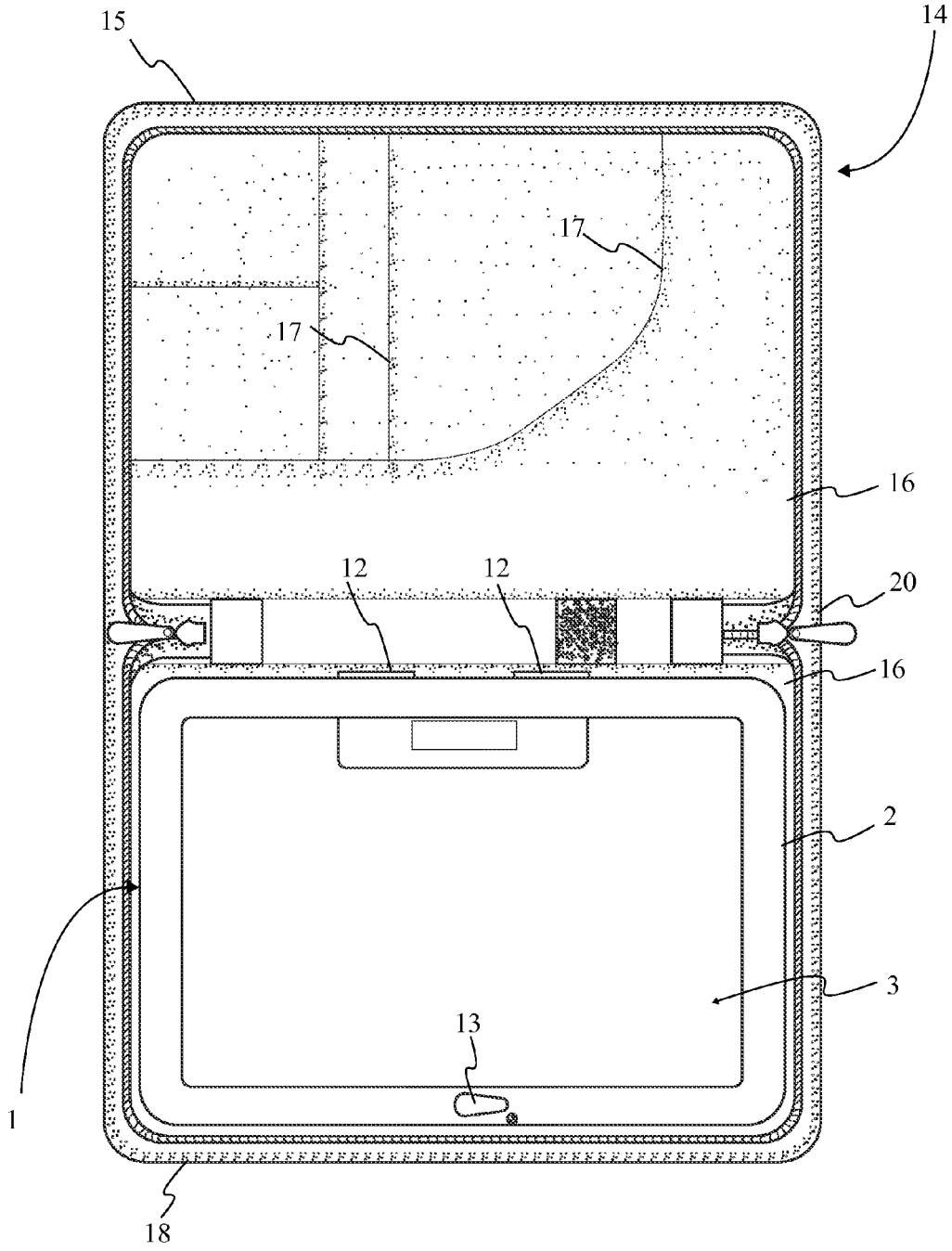
FIG. 2 is a top elevational view displaying the inner sleeve attached to the outer case as per the current embodiment of the present invention.

Referencing FIG. 1 and FIG. 2, the mobile device enclosure system is a provided as a housing that protects a mobile device for the wear and tear associated with everyday usage without limiting said neither mobile device's portability or the inhibiting access to said mobile devices hardware keys and charging ports. In the current embodiment of the present invention, the mobile device enclosure comprises an inner sleeve 1 and an outer case 14. The inner sleeve 1 functions as a primary enclosure that retains the mobile device and protects said mobile device from minor wear and tear. It should be noted that minor wear and tear is used to describe wear and tear to a mobile device that would result in cosmetic damage. The outer case 14 functions as a secondary enclosure which houses the inner sleeve 1 and the mobile device protecting both from major wear and tear as well as accidental damage. It should be noted that major wear and tear and accidental damage is used to describe serious damage to said mobile device requiring repair or replacement of components in order to allow the device to function properly. In order to provide this protection, the inner sleeve 1 is found detachably engaged within the outer case 14. The detachable engagement between the inner sleeve 1 and the outer case 14 additionally provides a rotatable coupling permitting the mobile device to be particularly arranged in alternative configurations for displaying videos in a landscape, horizontal orientation, or vertical, portrait orientation.

Figure 3:
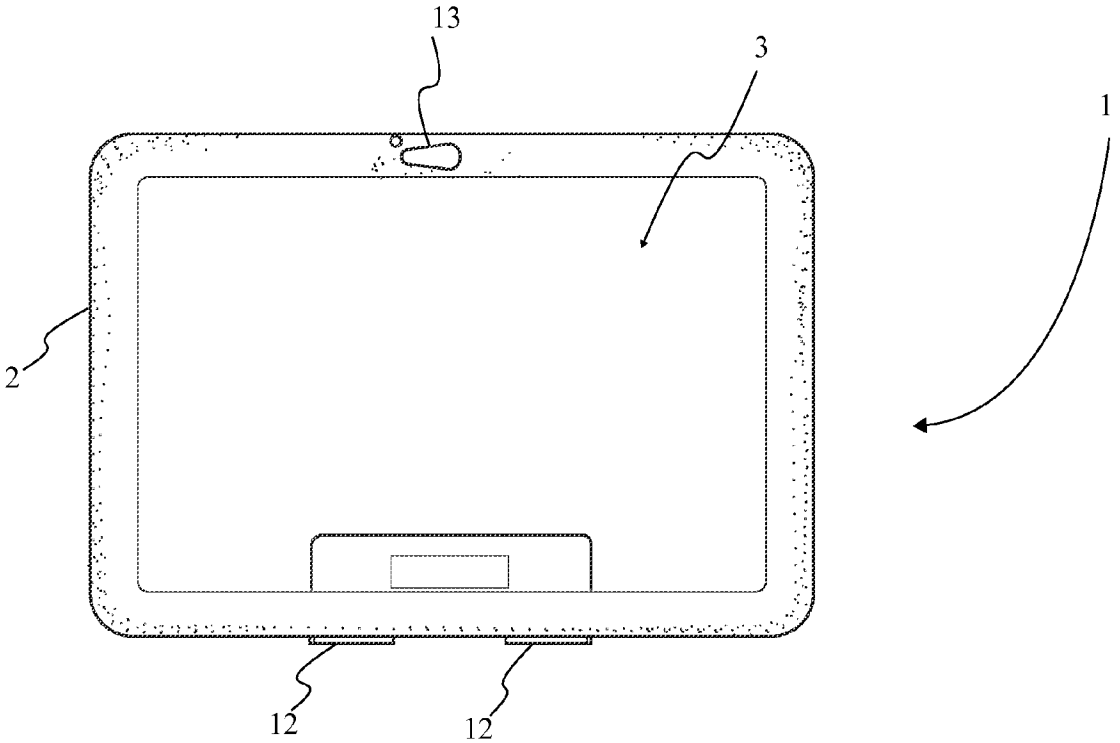
FIG. 3 is a top elevational view displaying the inner sleeve as per the current embodiment of the present invention.
Figure 4:
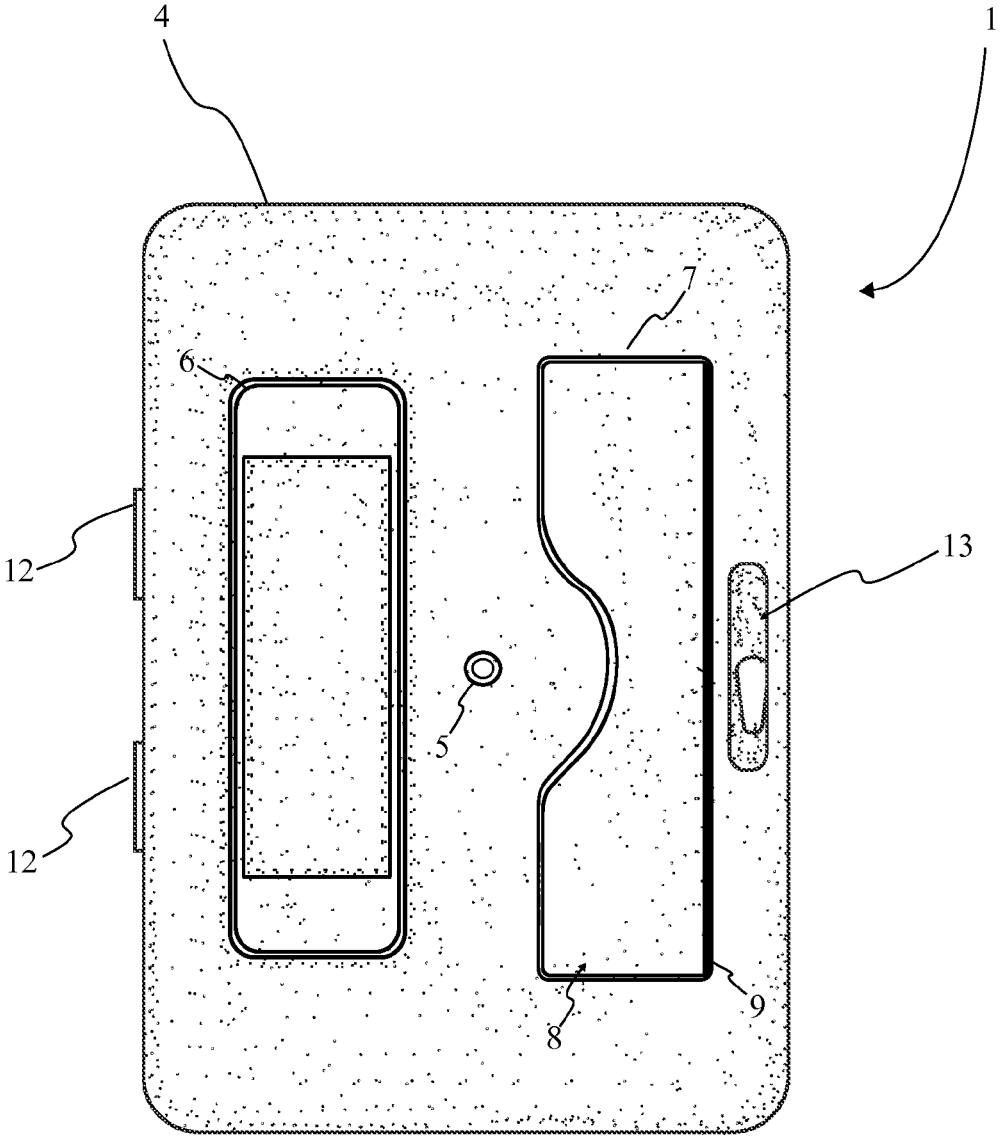
FIG. 4 is a bottom elevational view displaying the inner sleeve as per the current embodiment of the present invention.
Figure 8:
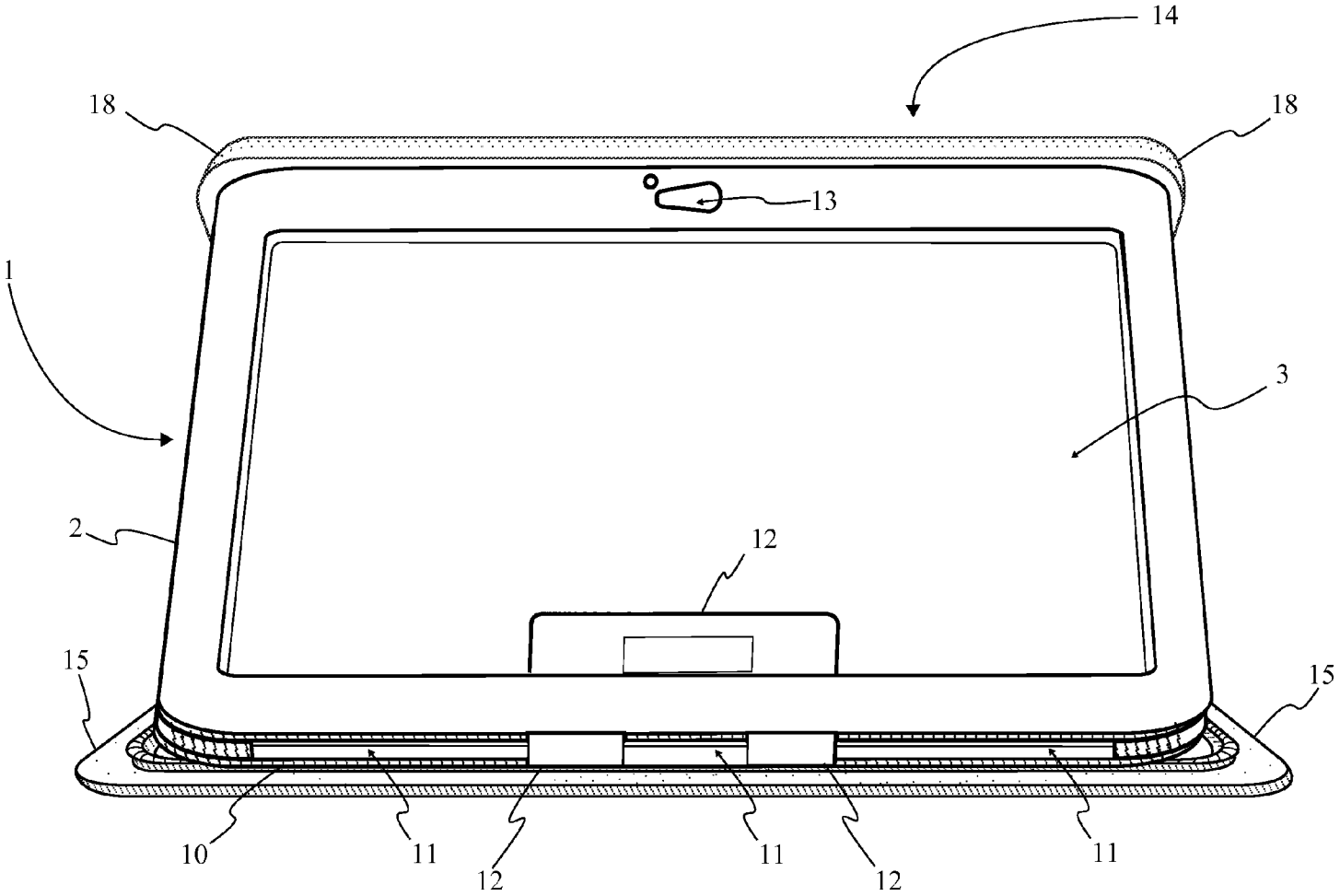
FIG. 8 is a perspective view displaying the inner sleeve mounted to the outer case in a landscape configuration as per the current embodiment of the present invention.

Referencing FIG. 3, FIG. 4, and FIG. 8, the inner sleeve 1 is provided as the primary enclosure that protects the mobile device from minor wear and tear. In the current embodiment of the present invention, the inner sleeve 1 comprises a front panel 2, a rear panel 4, a side wall 10, an inner sleeve opening 11, a side strap 12, and a plurality of port openings 13. The front panel 2 is provided as the portion of the inner sleeve 1 that is coincident with the display screen of a mobile device. The rear panel 4 is provided as the portion of the inner sleeve 1 that is coincident with the rear section of a mobile device. The side wall 10 is provided as a flexible member that perimetrically couples the front panel 2 and the rear panel 4 together. The side wall 10 juxtaposes the front panel 2 and the rear panel 4 parallel to one another, forming an interstitial space that is appropriately sized for housing a mobile device. The inner sleeve opening 11 is provided as the entrance that permits access to the interstitial space between the front panel 2 and the rear panel 4. The side strap 12 is provided as a means of securing the mobile device within the interstitial space by spanning the inner sleeve opening 11 and inhibiting the mobile device exiting the inner sleeve 1. The plurality of port openings 13 are provided as a mean of accessing the mobile devices hardware keys and charging ports, but can additionally allow access to the mobile devices camera lens. The plurality of port openings 13 are found particularly positioned on the front panel 2, the rear panel 4, and the side wall 10, wherein the particular positioning of the plurality of port openings 13 is provided in order to enable access to hardware keys, camera lenses, and various ports present on a particular mobile device. The front panel 2 is found juxtaposed parallel to the rear panel 4. The front panel 2 is flexibly coupled to the rear panel 4 by way of the side wall 10. The inner sleeve opening 11 traverses the side wall 10 between the front panel 2 and the rear panel 4. The side strap 12 is found flexibly coupled to the front panel 2, wherein the side strap 12 is affixed to the front panel 2 but permitted to flex in order to span across the inner sleeve opening 11 and detachably couple the rear panel 4. In the current embodiment of the present invention, the front panel 2 comprises an open viewing area 3. The open viewing area 3 centrally traverses the front panel 2. The positioning of the open viewing area 3 to the front panel 2 provides a frame configuration to the front panel 2 when aligned with the display portion of the mobile device.

Referencing FIG. 3-4, and FIG. 7-8, the rear panel 4 is the portion of the inner sleeve 1 that is coincident with the rear section of the mobile device. In the current embodiment of the present invention, the rear panel 4 comprises an outer case coupler 5, a hand strap 6, and a kickstand 7. The outer case coupler 5 is a complimenting component to a component on the outer case 14 that enables a detachable and rotatable coupling between inner sleeve 1 and the outer case 14. The hand strap 6 is provided as an integrated user maniputable engagement that facilitates holding and mobile device while housed within the inner sleeve 1. The kickstand 7 is an integrated component that is provided as means of inclining the mobile device housed within the inner sleeve 1 in order to function, exclusively, as a touch screen keyboard, wherein deployment of the kickstand 7 angles the mobile device in manner permitting a user's fingers facilitated engagement of the touch screen keys. The outer case coupler 5 is centrally positioned on the rear panel 4 opposite the front panel 2. The outer case coupler 5 is found positioned between the hand strap 6 and the kickstand 7. Both the hand strap 6 and the kickstand 7 are positioned flush with the rear panel 4, wherein both the hand strap 6 and the kickstand 7 do not protrude from the rear panel 4 in their resting state. In the current embodiment of the present invention, the kickstand 7 comprises a recessed flap 8 and a hinge 9. The recessed flap 8 is the structural portion of the kickstand 7 that pivots about the hinge 9 becoming perpendicular with the horizontal in order to incline the inner sleeve 1. The hinge 9 is the portion of the kickstand 7 that permits the hinge 9 to pivot. The hinge 9 is found integrally coupled to the rear panel 4 and the recessed flap 8. The thing is positioned opposite the outer case coupler 5 across the recessed flap 8.

Figure 5:
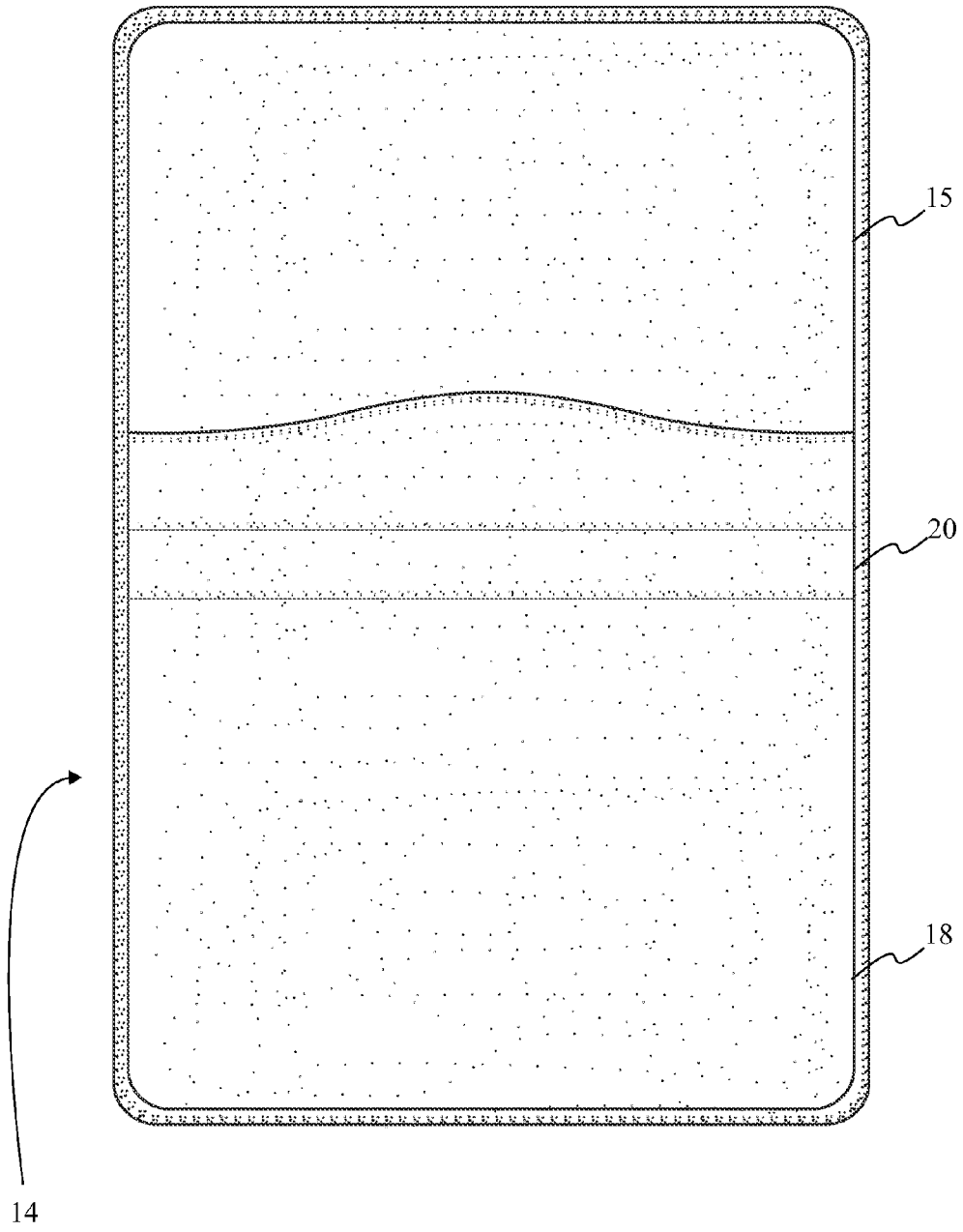
FIG. 5 is a bottom elevational view displaying the outer case as per the current embodiment of the present invention.
Figure 6:
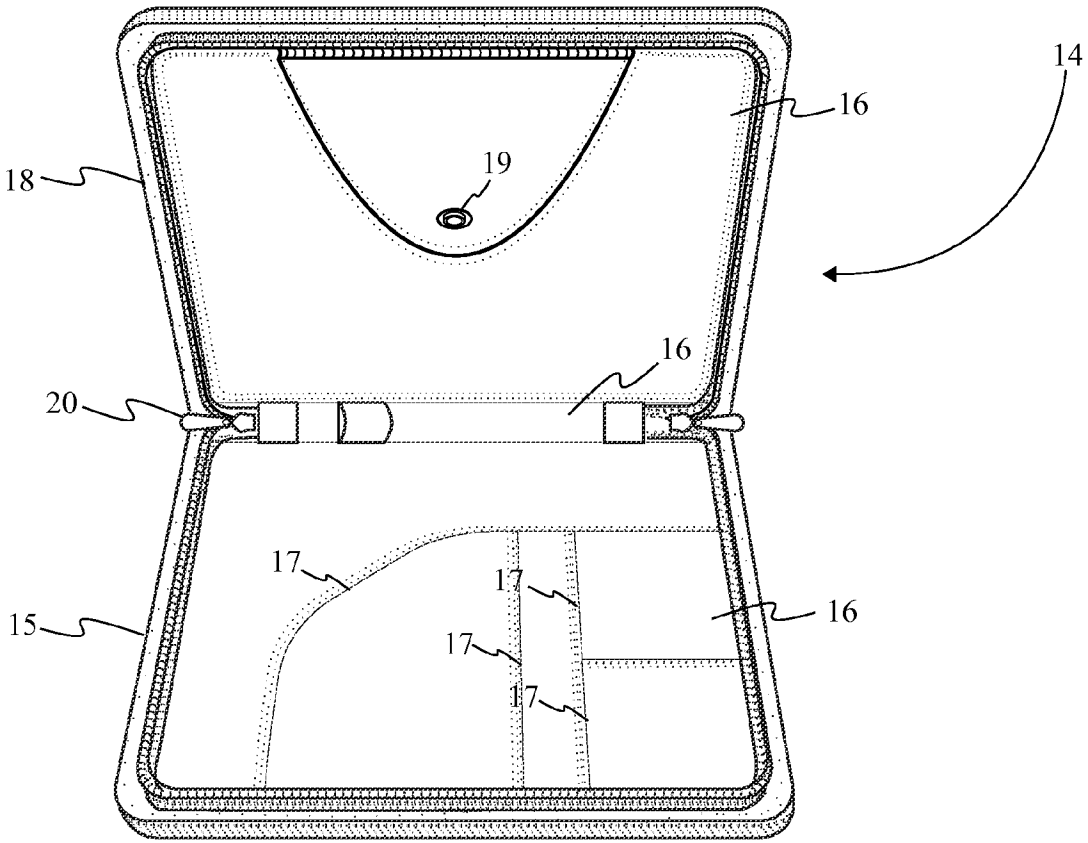
FIG. 6 is a perspective view displaying the outer case without as per the current embodiment of the present invention.

Referencing FIG. 5 and FIG. 6, the outer case 14 is provided as the secondary enclosure that protects the mobile device housed within the inner sleeve 1 from major wear and tear as well as accidental damage. In the current embodiment of the present invention, the outer case 14 comprises a first outer flap 15, a second outer flap 18, and a sleeve fold 20. The first outer flap 15 and the second outer flap 18 are provided as functionally similar components that are pivotally coupled to each other through the sleeve fold 20. The first outer flap 15 and the second outer flap 18 are both rigid padded panels that protect the mobile device from major damage. The sleeve fold 20 is positioned between the first outer flap 15 and the second outer flap 18. In the current embodiment of the present invention, the first outer flap 15, the second outer flap 18, and the sleeve fold 20 each comprise an interior face side 16. the interior face side 16 of the first outer flap 15, the interior face side 16 of the second outer flap 18, and the interior face side 16 of the sleeve fold 20 are found positioned coincident to each other. The interior face side 16 is the side face of the first outer flap 15, the second outer flap 18, and the sleeve fold 20 that is positioned proximal to the inner sleeve 1. When the inner sleeve 1 is found removeably coupled within the outer case 14, the interior face side 16 of the first outer flap 15, the interior face side 16 of the second outer flap 18 and the interior face side 16 of the sleeve fold 20 peripherally surround the inner sleeve 1. It should be noted that in the current embodiment of the present invention, the first outer flap 15 and the second outer flap 18 are engage by a peripherally positioned coupler which engages the first outer flap 15 and the second outer flap 18 opposite the positioning of the sleeve fold 20, in order to provide a more secure enclosure.

Figure 7:
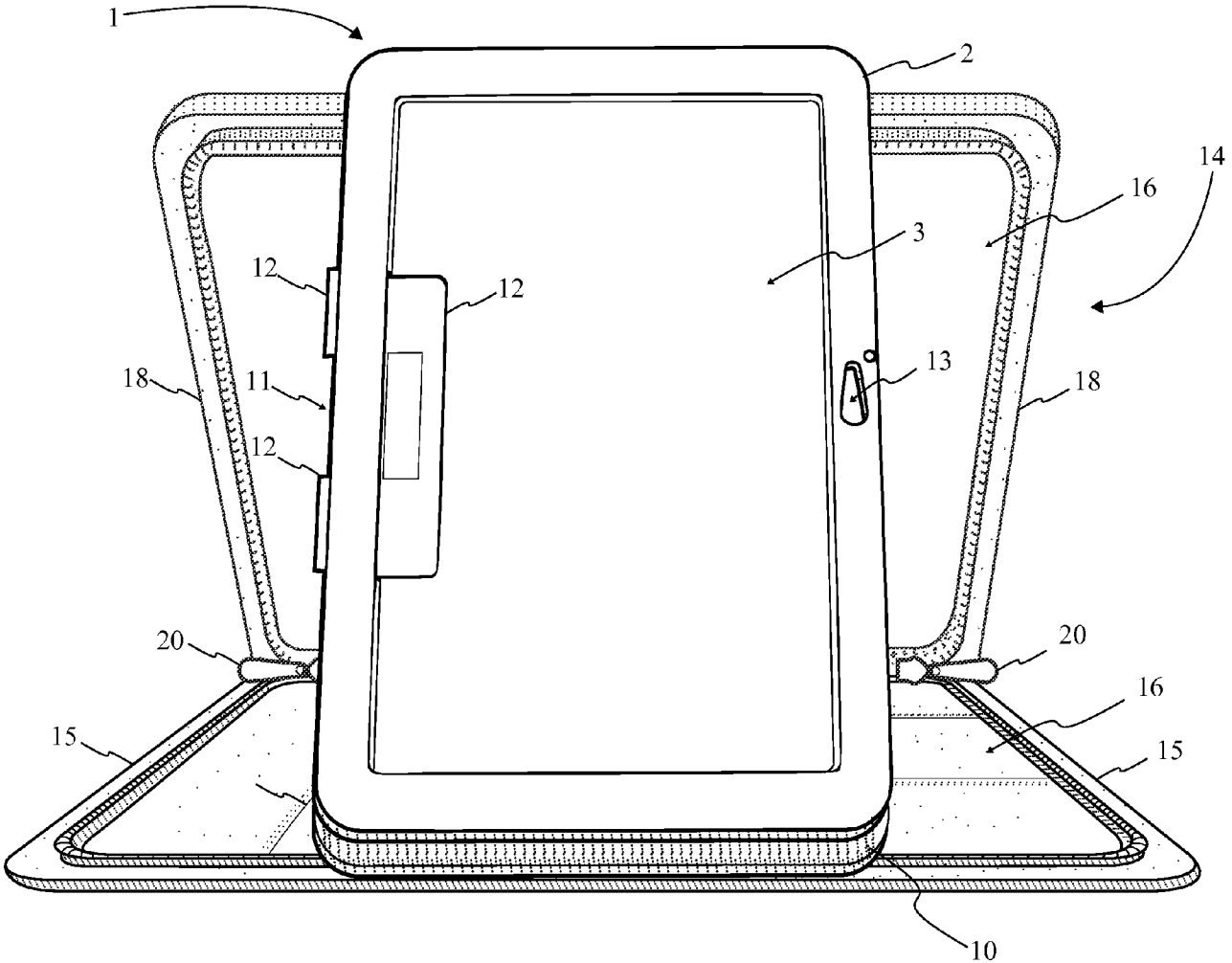
FIG. 7 is a perspective view displaying the inner sleeve mounted to the outer case in a portrait configuration as per the current embodiment of the present invention.

Referencing FIG. 5, FIG. 6, and FIG. 7, the second outer flap 18 is provided as a rigid padded panel that functions in conjunction with the first outer panel and the sleeve fold 20 in order to protect the mobile device enclosed within the inner sleeve 1. In the current embodiment of the present invention, the interior face side 16 of the second outer flap 18 comprises an inner sleeve mount 19. The inner sleeve mount 19 is an engageable flap that is pivotably coupled to the interior face side 16 of the second outer flap 18. The inner sleeve mount 19 is a complimenting component to the outer case coupler 5 on the rear panel 4. The engagement between the outer case coupler 5 and the inner sleeve mount 19 enables a detachable and rotatable coupling between the rear panel 4 and the interior face side 16 of the second outer flap 18. While the engagement mechanism of the outer case coupler 5 and the inner sleeve mount 19 are not explicitly described, it should be noted that both the outer case coupler 5 and the inner sleeve mount 19 could be provided as any engagement mechanism that detachably and rotatably couples the inner sleeve 1 to the outer case 14. In the preferred embodiment of the present invention the outer case coupler 5 and the inner sleeve mount 19 are buckle fasteners.

In the current embodiment of the present invention, the interior face side 16 of the first outer flap 15 comprises a plurality of accessory pockets 17. The plurality of accessory pockets 17 function as a convenient storage location for accessories of the mobile device as well as an alternative storage location for anything the user wishes to store. In the current embodiment of the present invention, the interior face side 16 of the sleeve fold 20 comprises an accessory mount. The accessory mount functions as an attachment point for storing a stylus or another kind of cylindrical accessory.

In the current embodiment of the present invention, the first outer flap 15 may additionally comprises a sleep mode activator. The sleep mode activator would provide the present invention with a means of putting the mobile device in sleep mode when the device is positioned within the outer case 14. The sleep mode activator would be internally positioned within the first outer flap 15 and would activate sleep mode on a mobile device when the first outer flap 15 becomes parallel with the second outer flap 18.

The present invention is a mobile device enclosure system designed to protect mobile devices such as tablet computers, tablet PC, or any other tablet type electronic device including but not limited to various generations Apple iPad, Amazon Kindle, Nook, Acer Iconia Tab Tablet, Samsung Galaxy, Asus Transformer Pad, Lenovo IdeaPad K1, Lenovo ThinkPad 1838, LG G-Slate 8.9, Motorola DROID, Sony S1, and etc.

The present invention protects the mobile device from damages and scratches by encasing the mobile devices in a protective case. The mobile device enclosure system acts as an impact absorber and prevents internal damage to the electronics of the mobile device. This is due to the fact that electronic components of a mobile device, may fail if they are subjected to heavy vibrations or sudden impulses.

The present invention comprises an outer case 14 and an inner sleeve 1. The inner sleeve 1 receives the mobile device. The present invention may utilize a plurality of Velcro strips, a plurality of magnets, and a plurality of grooves on the inside of the outer case 14, a zipper, a plurality of holders, and a stand on the back of the inner sleeve 1. The present invention may have a logo that is preferably stamped on the outer case 14, although any desired printing method may be used.

The present invention is preferably constructed using genuine cowhide leather on the outside of the outer case 14, although any desired material may be used. The interior face side 16 of the outer case 14 and the interior portion of the inner sleeve 1 are constructed of micro suede, although any desired material may be used. The micro suede material provides a smooth and soft cushion for the mobile device. The present invention utilizes a rigid internal material to create a structurally strong outer case 14 and inner sleeve 1. The cowhide and micro suede are preferably stitched together and sandwich the rigid internal material in the middle to create a sturdy shape, although any desired means of attachment may be used.

The outer case and the inner sleeve 1 comprise a plurality of port openings 13 that are strategically placed in conjunction with cameras, light sensors, and other ports on each specific mobile device. These ports include but are not limited to charging ports, headphone jacks, speaker ports, and etc. The plurality of port openings 13 allow the user to still utilize the camera and other ports on the mobile device without having to remove the inner sleeve 1 and outer case 14. The sleeve fold 20 also comprises an accessory mount on the right flap to allow the user to attach and store a stylus or a pen.

In an additional embodiment of the present invention comprises a built in stand features would be provided on the outer case 14 in order to allow the user to view the mobile device in multiple angles. The first outer flap 15 would comprise a plurality of grooves on the interior face side 16 that would permit the orientation of the mobile device into a plurality of different viewing angles.

In an additional embodiment of the present invention, a large strip of Velcro would be sewn into the interior face side 16 of the second outer flap 18 to attach the inner sleeve 1 in a landscape and/or a portrait view. The inner sleeve 1 rests on the grooves to provide a wide variety of viewing angles for the user. The different viewing angles may be adjusted by moving the inner sleeve 1 forwards or backwards along a groove plate until an edge of the inner sleeve 1 falls into one of the groove.

In an additional embodiment of the present invention, the interior face side 16 of the second outer flap 18 would comprises a fold positioned below the large strip of Velcro to convert the outer case 14 into a stand. The fold comprises stitching along the groove to provide a solid hold and prevents separation.

In an additional embodiment of the present invention, the second outer flap 18 would comprise a plurality of folds permitting it to bends in the middle. The second outer flap 18 would be able to wrap around the back to create a folded down flat configuration for the user to view and use the mobile device.

In an additional embodiment of the present invention, the inner sleeve 1 is constructed of genuine cowhide leather, although any desired material may be used. The interior portion of the inner sleeve 1 is lined with soft felt material to avoid scratching the device. The rear panel 4 of the inner sleeve 1 is lined with the same felt material to attach and detach from outer case for handheld operation and to manipulate the tablet in a portrait and/or a landscape view.

In an additional embodiment of the present invention, the inner sleeve 1 comprises a sewn on leather flap that holds a strip of Velcro hook and a Velcro loop sewn on the interior portion of the inner sleeve 1 in order to secure the tablet while inside sleeve.

In an additional embodiment of the present invention, a plurality of magnets are positioned underneath the suede like material on the peripheral edges of the first outer flap 15 and the second outer flap 18. The magnetic flap closure would able to secure mobile device within the outer case 14. The magnetic flap closure may also automatically sleeps and wakes the new iPad 2 and iPad 3 devices.

In an alternative embodiment of the present invention, the an outer case 14 would utilize a dual zipper for easy access, a detachable inner sleeve 1 for handheld operation, a plurality of slots with accessory flaps, and a rear stand for comfortable viewing at a 45° degree angle. In the alternative embodiment of the present invention, a large strip of Velcro would be sewn into the interior face side 16 of second outer flap 18. The large strip of Velcro would be used to attach the inner sleeve 1 case in landscape and/or portrait views. In the alternative embodiment of the present invention, the outer case 14 comprises a decorative stitching pattern to give the case a unique and attractive look.

In an alternative embodiment of the present invention, the center portion of the outer case 14 comprises a sleeve fold 20 that bends in the middle to close the case. Along with the sleeve fold 20, the alternative embodiment comprises a dual zipper that secures the case and prevents any accidental separation.

In an alternative embodiment of the present invention, the outer case 14 comprises a rear stand that is attached on the exterior side face of the second outer flap 18 to allow a 45° degree viewing angle. The rear stand comprises a strap that prevents the stand from separating from the case. The rear stand also comprises a plurality of magnets that are attached in the stand and the case to hold the stand in a flat configuration when the stand is not in use.

In an alternative embodiment of the present invention, the inner sleeve 1 comprises a sewn on leather flap in order secure the mobile device while stored in the inner sleeve 1. The inner sleeve 1 utilizes a plurality of port openings 13 that are purposefully placed in combination with cameras ports, light sensors, and other ports on each specific electronic device.

Although the invention has been explained in relation to its preferred embodiment, it is to be understood that many other possible modifications and variations can be made without departing from the spirit and scope of the invention as hereinafter claimed.

What is claimed is:

1. A mobile device enclosure system comprises:

an inner sleeve;

an outer case;

the inner sleeve comprises a front panel, a rear panel, a side wall, an inner sleeve opening, a side strap, and a plurality of port openings;

the outer case comprises a first outer flap, a second outer flap, and a sleeve fold;

the front panel comprises an open viewing area;

the rear panel comprises an outer case coupler, a hand strap, and a kickstand;

the side wall comprises the inner sleeve opening;

the first outer flap, the second outer flap, and the sleeve fold each comprise an interior face side;

the kickstand comprises a recessed flap and a hinge;

the interior face side of the second outer flap comprises an inner sleeve mount;

the inner sleeve being rotatably coupled to the outer case; and the inner sleeve being detachably coupled between the first outer flap and the second outer flap.

2. The mobile device enclosure system as claimed in claim 1 comprises:

the sleeve fold being positioned between the first outer flap and the second outer flap;

the first outer flap being pivotally coupled to the second outer flap by way of the sleeve fold;

the interior face side of the first outer flap, being coincident with the interior face side of the sleeve fold, and the interior face side of the second outer flap;

the inner sleeve being peripherally surrounded by the interior face side of the first outer flap, the interior face side of the sleeve fold, and the interior face side of the second outer flap; and the rear panel being detachably coupled to the interior face of the second outer flap.

3. The mobile device enclosure system as claimed in claim 1, wherein the interior face side of the first outer flap comprises a plurality of accessory pockets.

4. The mobile device enclosure system as claimed in claim 3, wherein the interior face side of the sleeve fold comprises an accessory mount.

5. The mobile device enclosure system as claimed in claim 3 comprises:

the inner sleeve mount being pivotably coupled to the interior face side of the second outer flap;

the outer case coupler being detachably engaged to the inner sleeve mount; and the outer case coupler being rotatably attached to the inner sleeve mount.

6. The mobile device enclosure system as claimed in claim 1 comprises:

the plurality of port opening being particularly positioned on the front panel, the rear panel, and the side wall;

the open viewing area centrally traverses the front panel;

the front panel being juxtaposed parallel to the rear panel;

the front panel being flexibly coupled to the rear panel by way of the side wall;

the front panel being perimetrically engaged to the side wall;

the rear panel being perimetrically engaged to the side wall opposite the front panel;

the inner sleeve opening traverses the side wall between the front panel and the rear panel;

the side strap being flexibly coupled to the front panel;

the side strap being detachably coupled to the rear panel; and the side strap spans across the inner sleeve opening, wherein the side strap spans across the inner sleeve opening from the front panel to the rear panel.

7. The mobile device enclosure system as claimed in claim 1 comprises:

the outer case coupler being centrally positioned on the rear panel opposite the front panel;

the outer case coupler being positioned between the hand strap and the kick stand;

the hand strap and the kick stand being positioned flush with the rear panel;

the recessed flap being pivotally engaged to the rear panel by way of the hinge; and the recessed flap being positioned between the hinge and the outer case coupler.

8. A mobile device enclosure system comprises:

an inner sleeve;

an outer case;

the inner sleeve comprises a front panel, a rear panel, a side wall, an inner sleeve opening, a side strap, and a plurality of port openings;

the outer case comprises a first outer flap, a second outer flap, and a sleeve fold;

the front panel comprises an open viewing area;

the rear panel comprises an outer case coupler, a hand strap, and a kickstand;

the side wall comprises the inner sleeve opening;

the first outer flap, the second outer flap, and the sleeve fold each comprise an interior face side;

the kickstand comprises a recessed flap and a hinge;

the interior face side of the second outer flap comprises an inner sleeve mount;

the inner sleeve being rotatably coupled to the outer case;

the inner sleeve being detachably coupled between the first outer flap and the second outer flap;

the plurality of port opening being particularly positioned on the front panel, the rear panel, and the side wall;

the open viewing area centrally traverses the front panel;

the front panel being juxtaposed parallel to the rear panel;

the front panel being flexibly coupled to the rear panel by way of the side wall;

the front panel being perimetrically engaged to the side wall; and the rear panel being perimetrically engaged to the side wall opposite the front panel.

9. The mobile device enclosure system as claimed in claim 8 comprises:

the sleeve fold being positioned between the first outer flap and the second outer flap;

the first outer flap being pivotally coupled to the second outer flap by way of the sleeve fold;

the interior face side of the first outer flap, being coincident with the interior face side of the sleeve fold, and the interior face side of the second outer flap;

the inner sleeve being peripherally surrounded by the interior face side of the first outer flap, the interior face side of the sleeve fold, and the interior face side of the second outer flap; and the rear panel being detachably coupled to the interior face of the second outer flap.

10. The mobile device enclosure system as claimed in claim 9, wherein the interior face side of the first outer flap comprises a plurality of accessory pockets.

11. The mobile device enclosure system as claimed in claim 9, wherein the interior face side of the sleeve fold comprises an accessory mount.

12. The mobile device enclosure system as claimed in claim 9 comprises:

the inner sleeve mount being pivotably coupled to the interior face side of the second outer flap;

the outer case coupler being detachably engaged to the inner sleeve mount; and the outer case coupler being rotatably attached to the inner sleeve mount.

13. The mobile device enclosure system as claimed in claim 8 comprises:

the inner sleeve opening traverses the side wall between the front panel and the rear panel;

the side strap being flexibly coupled to the front panel;

the side strap being detachably coupled to the rear panel;

the side strap spans across the inner sleeve opening, wherein the side strap spans across the inner sleeve opening from the front panel to the rear panel;

the outer case coupler being centrally positioned on the rear panel opposite the front panel;

the outer case coupler being positioned between the hand strap and the kick stand;

the hand strap and the kick stand being positioned flush with the rear panel;

the recessed flap being pivotally engaged to the rear panel by way of the hinge; and the recessed flap being positioned between the hinge and the outer case coupler.

14. A mobile device enclosure system comprises:

an inner sleeve;

an outer case;

the inner sleeve comprises a front panel, a rear panel, a side wall, an inner sleeve opening, a side strap, and a plurality of port openings;

the outer case comprises a first outer flap, a second outer flap, and a sleeve fold;

the front panel comprises an open viewing area;

the rear panel comprises an outer case coupler, a hand strap, and a kickstand;

the side wall comprises the inner sleeve opening;

the first outer flap, the second outer flap, and the sleeve fold each comprise an interior face side;

the kickstand comprises a recessed flap and a hinge;

the interior face side of the second outer flap comprises an inner sleeve mount;

the inner sleeve being rotatably coupled to the outer case;

the inner sleeve being detachably coupled between the first outer flap and the second outer flap;

the plurality of port opening being particularly positioned on the front panel, the rear panel, and the side wall;

the open viewing area centrally traverses the front panel;

the front panel being juxtaposed parallel to the rear panel;

the front panel being flexibly coupled to the rear panel by way of the side wall;

the front panel being perimetrically engaged to the side wall;

the rear panel being perimetrically engaged to the side wall opposite the front panel;

the inner sleeve opening traverses the side wall between the front panel and the rear panel;

the side strap being flexibly coupled to the front panel;

the side strap being detachably coupled to the rear panel;

the side strap spans across the inner sleeve opening, wherein the side strap spans across the inner sleeve opening from the front panel to the rear panel;

the outer case coupler being centrally positioned on the rear panel opposite the front panel;

the outer case coupler being positioned between the hand strap and the kick stand;

the hand strap and the kick stand being positioned flush with the rear panel;

the recessed flap being pivotally engaged to the rear panel by way of the hinge; and the recessed flap being positioned between the hinge and the outer case coupler.

15. The mobile device enclosure system as claimed in claim 14 comprises:

the sleeve fold being positioned between the first outer flap and the second outer flap;

the first outer flap being pivotally coupled to the second outer flap by way of the sleeve fold;

the interior face side of the first outer flap, being coincident with the interior face side of the sleeve fold, and the interior face side of the second outer flap;

the inner sleeve being peripherally surrounded by the interior face side of the first outer flap, the interior face side of the sleeve fold, and the interior face side of the second outer flap; and the rear panel being detachably coupled to the interior face of the second outer flap.

16. The mobile device enclosure system as claimed in claim 15, wherein the interior face side of the first outer flap comprises a plurality of accessory pockets.

17. The mobile device enclosure system as claimed in claim 15, wherein the interior face side of the sleeve fold comprises an accessory mount.

18. The mobile device enclosure system as claimed in claim 15 comprises:

the inner sleeve mount being pivotably coupled to the interior face side of the second outer flap;

the outer case coupler being detachably engaged to the inner sleeve mount; and the outer case coupler being rotatably attached to the inner sleeve mount.

* * * * *